United States Patent [19]

Leslie et al.

[11] 4,189,030

[45] Feb. 19, 1980

[54] WEB LADDER

[76] Inventors: Frank B. Leslie, 8883 Niagara River Parkway, Niagara Falls, Ontario L2E 6S6; Alexander S. Kiss, P.O. Box 209, Queenston, Ontario, both of Canada

[21] Appl. No.: 968,310

[22] Filed: Dec. 11, 1978

[30] Foreign Application Priority Data

Mar. 1, 1978 [CA] Canada ..... 298018

[51] Int. Cl.[2] ..... E06C 1/56

[52] U.S. Cl. ..... 182/196; 182/70

[58] Field of Search ..... 182/196, 197, 198, 70, 182/76, 164, 163, 95, 96, 199

[56] References Cited

U.S. PATENT DOCUMENTS

| | | | |
|---|---|---|---|
| 266,183 | 10/1882 | Moore | 182/70 |
| 298,660 | 5/1884 | Bessier | 182/70 |
| 647,628 | 4/1900 | Heum | 182/196 |
| 686,182 | 11/1901 | Wright | 182/196 |
| 3,043,399 | 7/1962 | Marryatt | 182/196 |
| 3,307,654 | 3/1967 | Green | 182/198 |

*Primary Examiner*—Reinaldo P. Machado
*Attorney, Agent, or Firm*—Sim & McBurney

[57] ABSTRACT

This invention provides a collapsible web ladder in which a number of flat step members are connected to two flexible webs by virtue of T-shaped recesses in the ends of the step members. The flexible webs lodge in the recess portions corresponding to the cross-bars of the T's. Each web has affixed to it a plurality of spaced-apart block members which are adapted to lodge against and underneath the cross-bars of the T-shaped recesses, whereby weight placed on a step member can be transferred to the web.

8 Claims, 7 Drawing Figures

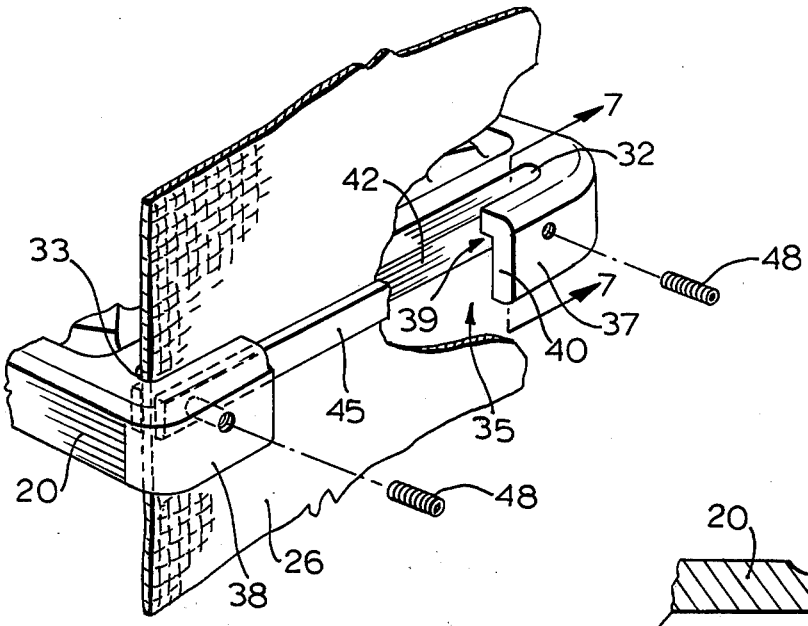
FIG. 5
FIG. 7
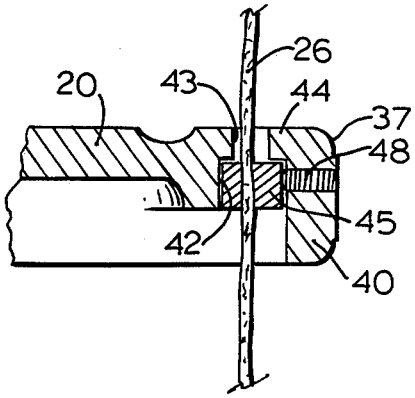
FIG. 6
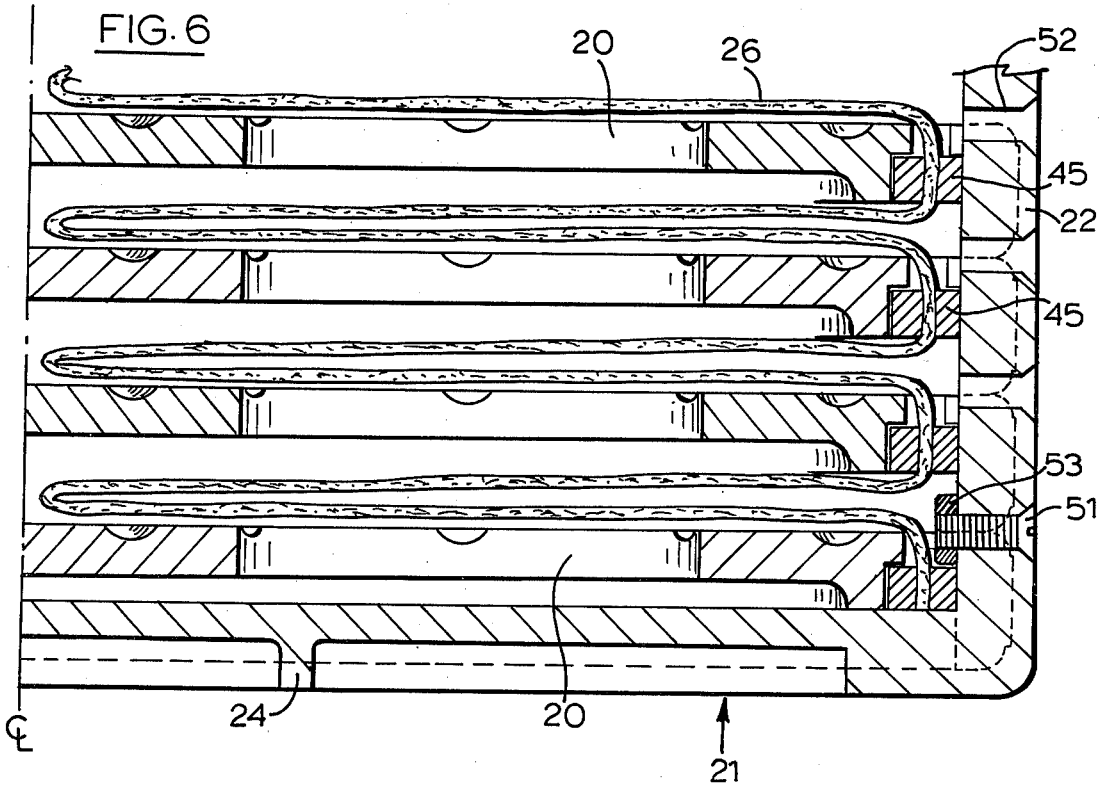

WEB LADDER

This invention relates generally to flexible ladders which may be used as emergency escapes from buildings, on the sides of boats, and similar settings where a collapsible ladder is required.

The prior art includes the well known "rope ladder" which generally consists of a series of rungs of circular section, tied together by two ropes. The disadvantages of rope ladders are serious ones, particularly when these are used as an escape route from a building. Firstly, when the rope ladder dangles down the side of the building, it is particularly difficult for the user to position his feet on the rungs as he descends. This is due to the fact that the rungs tend to lie very close in to the wall of the building. When the ladder is used by someone with bare feet, for example, during a nocturnal escape from a burning building, it is even more difficult and even hazardous to employ the rope ladder. The toes of the user tend to scrape against the brickwork, and can be cut or badly bruised.

Another disadvantage relates to the great degree of flexibility of the rope joining the rungs together. Because of the weight of the user, the rope ladder tends to be greatly distorted, depending upon the proportion of weight which the user applies through the hands as compared to the proportion through the feet. This can make it very difficult to find the rungs with the feet, during a descent.

It is with the foregoing disadvantages of conventional rope ladders in mind that the present invention has been elaborated.

Accordingly, this invention provides a collapsible web ladder comprising:

a plurality of flat, elongated step members, each member having at either end a T-shaped recess, the stems of the T-shaped recesses for each member extending away from each other, two flexible webs adapted to be inserted into the recesses at opposite ends of the step members to lie along the cross-bars of the "T"'s, the recesses at the "T" cross-bars being sized to snugly but slidably enclose the webs, each web having affixed to it at a plurality of longitudinally spaced locations block members having a width greater than the width of the recesses at the "T" cross-bars, whereby a block member can lodge against a step member adjacent the recess, and allow weight placed upon the step member to be transferred to the web, and means at the top of the webs for attachment to a securement member.

One embodiment of this invention is illustrated in the accompanying drawings, in which like numerals denote like parts throughout the several views, and in which:

FIG. 5 is a broken-away perspective view of one end of a step member;

FIG. 6 is a sectional view taken at the line 6—6 in FIG. 3; and

FIG. 7 is a sectional view taken at the line 7—7 in FIG. 5.

Figure 1:
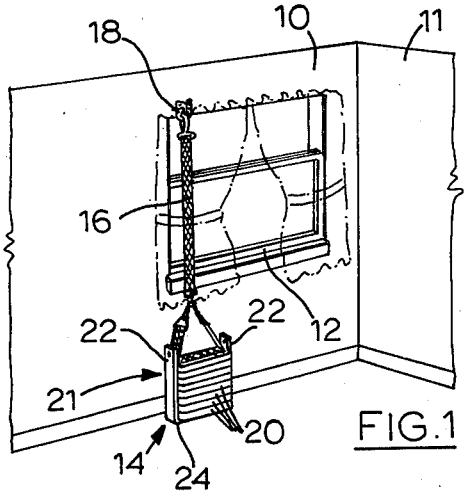
FIG. 1 is a perspective view of a web ladder in collapsed condition in a room.

Turning first to FIG. 1, there is shown a room including two walls 10 and 11, a window 12 in the wall 10, and a collapsed web ladder shown generally by the numeral 14 which is resting on the floor of the room, and which is attached to one end of the strap 16, the other end of which is clipped to a ring 18 securely mounted above the window 12.

In FIG. 1, the web ladder 14 is seen to include a plurality of step members 20 in vertically stacked relation, held in position in a stand 21 which includes two side members 22 extending vertically from a bottom horizontal member 24.

As can be seen in FIG. 1, the ring 18 is mounted closer to one side of the window 12 than to the other, so that the strap 16 can be covered by the window curtains (shown in broken lines).

Figure 2:
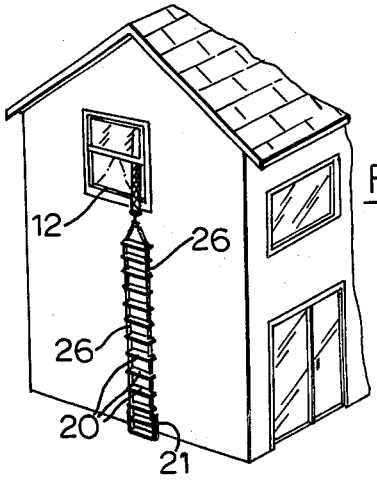
FIG. 2 is a partial outside view of a building with the web ladder of this invention in position for escape from a second storey.

Turning to FIG. 2, the same window 12 is shown from the outside of the building. The window 12 is open, and the web ladder 14 has been dropped out through the window, to assume its extended position. The individual rungs 20 are maintained in spaced vertical arrangement by two webs 26. The stand 21 can be seen at the bottom in FIG. 2.

Figure 3:
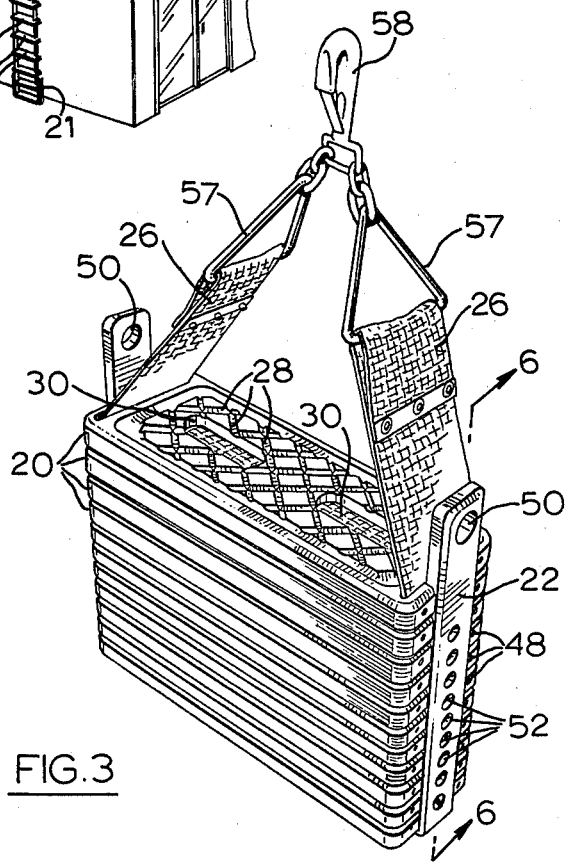
FIGS. 3 and 4 are perspective views of the web ladder in collapsed and extended positions respectively.

Turning now to FIG. 3, it can be seen that each step member 20 is elongated and of rectangular configuration with rounded corners. The top surface of the uppermost step member 20 is visible in FIG. 3, and this surface can be seen to be non-planar by virtue of being cross-hatched with indented channels 28. This non-planar surface texture is provided to allow a secure grip and good contact with the foot of the user.

Each step member 20 further includes two hand-holds of elongated oval configuration, the hand-holds being shown at 30 and being spaced along the longer dimension of the step member while being located centrally of its shorter dimension.

The end configuration of each step member 20 is best seen in FIG. 5, to which attention is now directed.

In FIG. 5, the step member 20 is provided with a T-shaped recess which includes a first slot 32 and a second slot 33, these constituting the cross-bar of the T-shaped recess. The stem of the T-shaped recess is located at 35 and is simply an opening or gap between two portions 37 and 38 which help to define the slots 32 and 33.

Each of the portions 37 and 38 has an undercut 39, which in effect causes the portions 37 and 38 to define downwardly extending flanges 40.

Inwardly adjacent the portions 37 and 38, the step member 20 defines a stepped wall 42 with an outwardly projecting upper part 43. As best seen in FIG. 7, the distance between the flange 40 and the lower part of the stepped wall 42 is wider than the distance between the part 43 and the top 44 of the portion 37, for a reason now to be explained.

Each of the flexible webs 26 is adapted to be inserted into the T-shaped recess at one end of each of the step members 20, and is intended, when in operative position, to lie along the cross-bars of the T-shaped recesses, i.e., within the slots 32 and 33 which are seen in FIG. 5. The web 26 in FIG. 5 is drawn in position, although the right-hand portion has been partly broken away to show the complete structure of the recess in the step member 20. The width of the slots 32 and 33 is such that the web 26 is slidably received therewithin.

Each web 26 has affixed to it at a plurality of longitudinally spaced locations a plurality of block members 45. Each block member extends to both sides of the web 26 and is greater than the width of the slots 32 and 33 (the cross-bars of the T-shaped recess).

The thickness of the block member 45, as can be seen in FIG. 7, is slightly less than the gap or distance between the flange 40 and the lower part of the stepped wall 42, whereby the block member 45 can lodge within this defined space, under the inwardly projecting ledge parts 43 and 44 which together define the narrower slots 32 and 33. In this manner, any weight placed upon the step member 22 can be transferred to the web 26, since the step member 20 is in effect bearing downwardly and resting against the block member 45, which is in turn affixed to the web 26. Normally, the webs would be of interwoven fibres, for example, nylon, and the block members 45 would be in the form of molded plastic or metal alloy elements interlocked with the woven web fibres.

As best seen in FIG. 5, two threaded allen screws 48 are provided to be threaded into tapped holes in the flanges 40 adjacent the slots 32 and 33, in order to tighten against the corresponding block member 45 and hold the same in position with respect to the step member 20.

Figure 4:
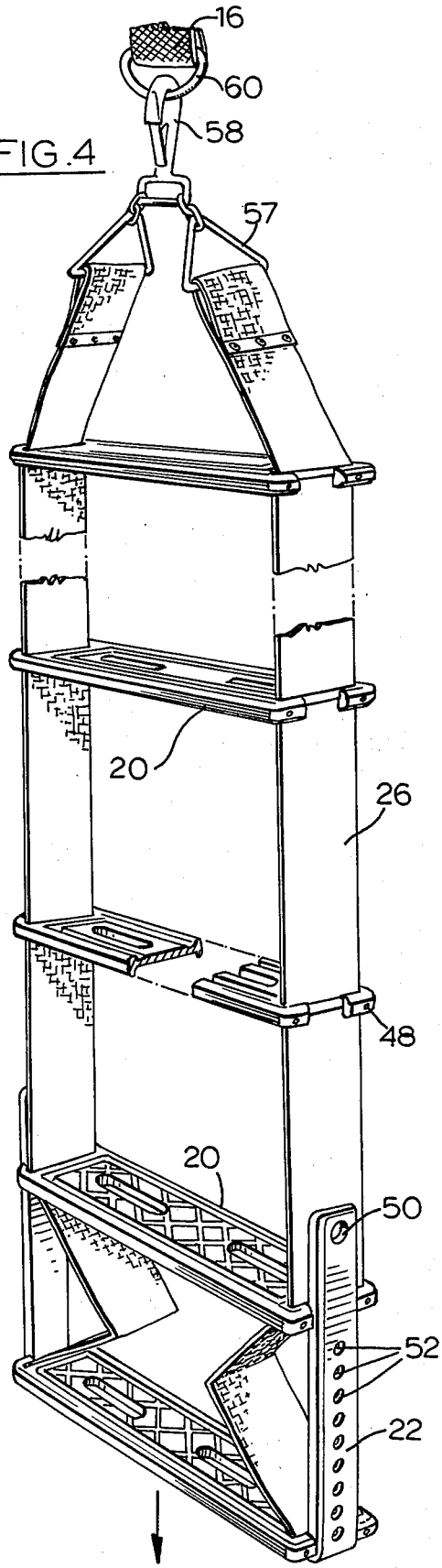

Referring again to the stand 21, attention may be directed to FIGS. 3, 4 and 6, in which it can be seen that the upstanding side members 22 have a width small enough to allow them to be received within the indentations in the step member ends which are defined by the stems of the T-shaped recesses, i.e. the gap between the portions 37 and 38 as seen in FIG. 5. This allows registration to take place as the step members 20 are fed downwardly from the top between the side members 22, so that the step members can be stacked between the side members as best seen in FIG. 3. The length of the side members 22 is greater than the full stacked height of the step members 20, and each side member 22 has a gripping hole 50 near the top by which the entire package may be manipulated, for example for the purpose of placing it into a suitable enclosure.

In FIG. 6, it can be seen that the bottom horizontal member 24 of the stand 21 is adapted to lie underneath the bottom step member 20.

Each of the side members 22 is provided with a plurality of bore-holes in vertical alignment along its length, the holes being at vertical spacings corresponding to the vertical thickness of the step members. These holes are identified by the numeral 52, and can be seen in FIG. 6 to be countersunk at the outside.

The holes 52 are positioned in such a way that, when the step members 20 are in stacked relation within the stand 21, the holes 52 are located between the pairs of vertically adjacent block members 45. This allows the use of fastener means such as a machine screw 51 to be inserted into any one of the holes 52 to project inwardly of the inward face of the side member 22, such that a nut 53 shown in solid lines adjacent the bottom hole 52 in FIG. 6, can be fastened into position thus locking into place the particular step member associated with the block member directly under the nut, as well as any and all step members below that particular step member.

The provision just described is useful for shortening the full extended length of the web ladder when the distance over which it is to be used is shorter than the full length.

As best seen FIGS. 2 and 4, the webs 26 are provided at their upper ends with means for attachment to a securement member. More specifically, each web 26 is connected in a conventional manner to a trangular ring 57, and each of the latter is connected in turn to a clip 58. The clip 58 can be attached to a ring 60 (FIG. 4) at the bottom of the strap 16 shown in FIG. 1.

As seen in FIG. 6 and at the bottom in FIG. 4, the webs are adapted to fold neatly in the spaces between adjacent step members 20. Each of the latter are shaped to define a bottom recess, surrounded by longitudinal extensions of the partitions 37 and 38 seen in FIG. 5.

It is pointed out that the ladder disclosed herein is such that it may be extended down the side of a building with either side against the building without affecting its function in any way. This constitutes an improvement over some prior art ladders, which require to be extended with a particular side against the building wall in order to be usable.

We claim:

1. A collapsible web ladder comprising:

a plurality of flat, elongated step members, each member having at either end a T-shaped recess, the stems of the T-shaped recesses for each member extending away from each other, two flexible webs adapted to be inserted into the recesses at opposite ends of the step members to lie along the cross-bars of the "T"'s, the recesses at the "T" cross-bars being sized to slidably enclose the webs, each web having affixed to it at a plurality of longitudinally spaced locations block members having a width greater than the width of the recesses at the "T" cross-bars, whereby a block member can lodge against a step member adjacent the recess, and allow weight placed upon the step member to be transferred to the web, and means at the top of the webs for attachment to a securement member.

2. The invention claimed in claim 1, in which the webs are of woven fibres, and each block member is a molded plastic element interlocked with the woven web fibres.

3. The invention claimed in claim 1 or claim 2, in which threaded locking means are provided on the step members to lock the said block members in position.

4. The invention claimed in claim 1 or claim 2, in which each step member includes downwardly extending flanges outwardly adjacent the portions of the recesses corresponding to the "T" cross-bar, each flange defining with the remainder of the respective step member a cavity large enough to receive a block member, there being for each block member at least one threaded fastener screwed through a threaded hole in one of the corresponding flanges and adapted to tighten against the block member to hold the same in position.

5. The invention claimed in claim 1, which further includes a stand for the web ladder when in collapsed condition, the stand including a bottom horizontal member and two upstanding side members, each side member having a width small enough to allow it to be received within the indentations in the step member ends defined by the stems of the T-shaped recesses, whereby the step members can be stacked between the side members of the stand.

6. The invention claimed in claim 5, in which each side member has a plurality of bore-holes along its length, at vertical spacings corresponding to the vertical thickness of the step members, there being fastener means capable of insertion into any one of the holes and including a nut member adapted to lie above one of the block members, thereby locking into place the particular step member associated with that block member and any step members below said particular step member.

7. The invention claimed in claim 1, in which each step member is elongated and of rectangular configuration, each step member having two hand-holes centrally of its shorter dimension and spaced along it in the longer dimension.

8. The invention claimed in claim 1, in which the webs are of woven fibers, and each block member is a metal alloy element interlocked with the woven web fibers.

* * * * *